United States Patent [19]

Daniel

[11] Patent Number: 4,530,417

[45] Date of Patent: Jul. 23, 1985

[54] SUPPRESSOR

[75] Inventor: Wayne Daniel, Atlanta, Ga.

[73] Assignee: SW Daniel, Inc., Atlanta, Ga.

[21] Appl. No.: 506,812

[22] Filed: Jun. 22, 1983

[51] Int. Cl.[3] ..... F41C 21/18

[52] U.S. Cl. ..... 181/223; 181/252; 181/281; 89/14.4

[58] Field of Search ..... 89/14 R, 14 B, 14 C, 89/14 D; 181/223, 252, 256, 264, 281

[56] References Cited

U.S. PATENT DOCUMENTS

| | | | |
|---|---|---|---|
| 2,043,731 | 6/1936 | Bourne | 181/248 |
| 2,073,951 | 3/1937 | Servais | 181/252 |
| 2,442,773 | 6/1948 | Mason | 181/223 |
| 2,448,382 | 8/1948 | Mason | 89/14.4 |
| 3,713,362 | 1/1973 | Charron | 89/14.4 |
| 3,748,956 | 7/1973 | Hubner | 89/14.4 |
| 4,291,610 | 9/1981 | Waiser | 89/14.4 |

FOREIGN PATENT DOCUMENTS

| | | | |
|---|---|---|---|
| 338641 | 3/1936 | Italy | 181/223 |

OTHER PUBLICATIONS

Siegfried F. Huebner, Silencers for Hand Firearms, 1976, pp. 74, 76.

Frankford Arsenal Report R-1896, Silencers Patterns and Principles, Aug. 1968, pp. 112-119.

*Primary Examiner*—Stephen C. Bentley

*Attorney, Agent, or Firm*—Jones & Askew

[57] ABSTRACT

A suppressor for reducing the muzzle blast of firearms or the like. Several separate absorbent elements are aligned in tandem within a tubular housing, and adjacent absorbent elements are separated by triangular baffles which expose end portions of adjacent absorbent elements. These exposed end surface portions enhance dispersion of propellant gases into and through the absorbent elements. The absorbent elements preferably are made of a knitted ferrous or non-ferrous wire mesh, providing a number of tortuous paths for gas dispersion into the absorbent elements and lowering the temperature of the gases to reduce the noise of the muzzle blast.

7 Claims, 4 Drawing Figures

SUPPRESSOR

FIELD OF THE INVENTION

This invention relates in general to firearms, and in particular relates to apparatus for suppressing the muzzle blast and attendant noise of a firearm.

BACKGROUND OF THE INVENTION

Suppressors or so-called silencers for firearms generally operate to reduce the energy of the gases propelling the bullet from the muzzle of the firearm. By reducing the energy level of the propellant gases in a relatively controlled manner compared to the abrupt discharge of gases leaving the muzzle of an unsuppressed firearm, the audible noise or sharp report of the firing can be suppressed to a significant extent. One technique of suppressing the report of firearms calls for reducing the temperature of the propellant gases, before these gases are released to the atmosphere. Since the internal energy of a compressed gas is a function of the gas temperature, the energy of propellant gases exiting the suppressor at a reduced temperature thus is reduced, bringing about a corresponding reduction in the noise produced by the propellant gases.

Various kinds of suppressors seeking to accomplish the foregoing function are known to the prior art. A number of practical disadvantages generally are associated with these prior suppressors. For example, some suppressors require expansion chambers, baffle plates, partitions, or the like, machined or otherwise fabricated in a manner requiring relatively costly fabrication and assembly techniques. Because suppressors generally are attached to the muzzle of a firearm and extend a distance in front of the muzzle, the added diameter and weight of such existing suppressors frequently is another disadvantage.

One such suppressor, disclosed in U.S. Pat. No. 2,448,382, seeks to reduce these problems by providing the suppressor concentric with a portion of the rifled barrel of the firearm. Radial holes are drilled through the rifled barrel to vent the propellant gases into the surrounding suppressor. This arrangement, while reducing the overall length of firearm-suppressor combination, adversely affects the accuracy of the firearm unless the radial holes enter the rifled barrel only in the grooves of the rifling. This desired placement of the radial holes, while not impossible, calls for considerable manufacturing precision and thus is impractical.

SUMMARY OF INVENTION

The suppressor of the present invention reduces the energy of propellant gases, and thus reduces the associated firing noise or report, by apparatus including one or more absorbent elements serially disposed within a housing attachable to the muzzle of the firearm. Plural individual elements of absorbent material are preferred, and adjacent elements of the absorbent material are separated by a baffle which covers less than the entire end area of the adjacent elements, leaving a portion of the end area uncovered within the housing. These uncovered end portions enhance the passage of propellant gases into and through the gas-absorbent elements, improving the noise-suppressing ability of a suppressor according to the present invention having a given mass of absorbent material.

Stated somewhat more specifically, suppressors according to the present invention preferably use absorbent elements of knitted ferrous or non-ferrous material for absorbing and expanding the propellant gases and dissipating the heat from these gases. It is believed that the use of knitted material provides a labyrinth of closely-packed wires with interstitial spaces defined between the knitted wire mesh, thereby providing an increased expansion volume for the propellant gases and also substantially increasing the surface area of wire available to absorb heat from the propellant gases.

Accordingly, it is an object of the present invention to provide an improved suppressor for firearms or the like.

It is another object of the present invention to provide a suppressor which is relatively efficient in operation without adversely affecting the accuracy of the firearm.

It is still another object of the present invention to provide a suppressor which maximizes gas dispersion into the total interior volume of the suppressor.

Other objects and advantages of the present invention will become more readily apparent from the following discussion of a preferred embodiment.

DETAILED DESCRIPTION OF PREFERRED EMBODIMENT

Figure 1:
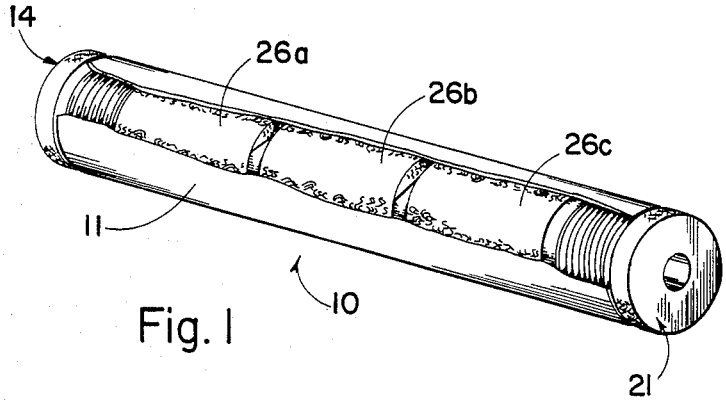
FIG. 1 is a pictorial view showing a suppressor according to a preferred embodiment of the present invention, and having a portion of the suppressor tube cut away for illustrative purposes.

Turning first to FIG. 1, there is shown generally at 10 a suppressor designed to be removably attached to the muzzle of a firearm (not shown) such as a hand gun or the like. The particular disclosed suppressor embodiment 10 is designed for use with a firearm chambered to fire the .22 long rifle cartridge, although it should be understood that the choice of a particular cartridge is not critical to the present invention.

Figure 2:
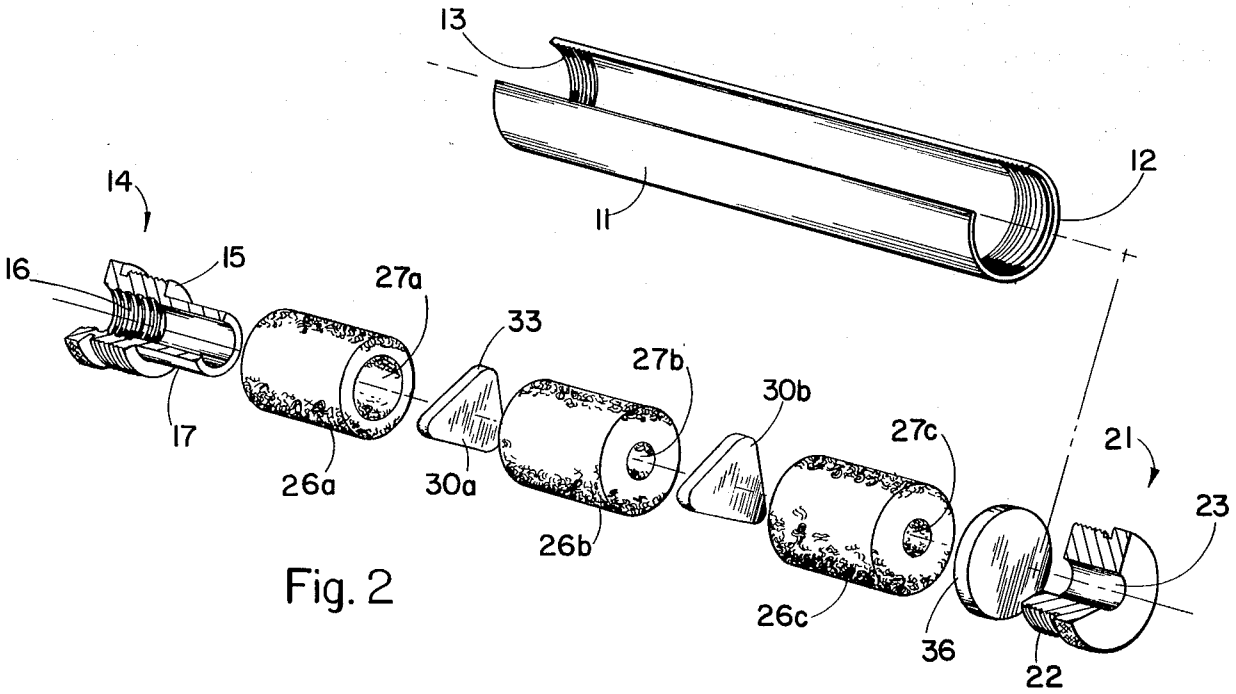
FIG. 2 is an exploded view of the suppressor shown in FIG. 1, with certain components shown broken away for illustration.

The suppressor 10 includes an elongated tubular housing 11 having threaded front and back ends 12 and 13, respectively, best seen in FIG. 2. At the back end 13 of the housing 11 is the connector sleeve 14, having an exterior-threaded body portion 15 which screws into the threaded back end of the housing. The connector sleeve 14 has an internal axial passage 16, FIGS. 2 and 3, which is threaded to fit corresponding external threads at the muzzle end of the firearm for which the suppressor 10 is to be used. The threads in the axial passage 16 preferably are relatively coarse, so as to facilitate removal and attachment of the suppressor from the firearm barrel.

Figure 3:
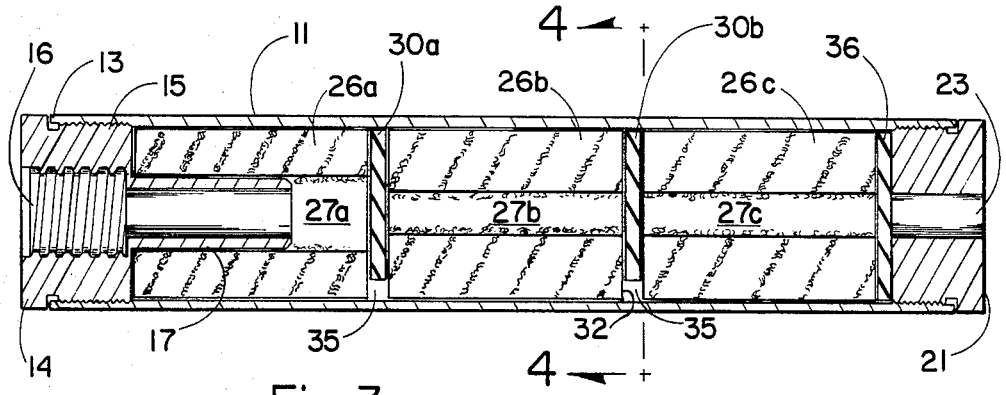
FIG. 3 is a longitudinal section view of the suppressor shown in FIG. 1.

A hollow neck 17 extends forwardly from the body portion 15 of the connector sleeve 14. The neck 17 has an open internal passage coaxial with the threaded axial passage 16 through the body portion 15. As seen in FIG. 3, it will be appreciated that the internal diameter of the passage in the neck 17 is sufficient to accommodate passage of bullets entering the suppressor through the connector sleeve 14. It will also be evident that the diameter of the axial passage 16 leading to the neck 17 is somewhat greater than the diameter of the passage in the neck, so as to accommodate the thickness of the threaded barrel to which the connector sleeve will be attached.

An encapsulator 21 is fitted to the front end 12 of the housing 11, and holds together the suppressor components within the housing. The encapsulator 21 has a body portion 22 externally threaded to fit within the threaded front end 12 of the suppressor housing 11. An axial passage 23 extends through the encapsulator 21, and it should be understood that the diameter of this axial passage is selected to permit unimpeded passage of bullets through the suppressor.

A number of separate absorbent elements are disposed within the housing 11 of the suppressor. Three such absorbent elements 26*a*, 26*b*, and 26*c*, taken from the back to the front of the suppressor, are used in the disclosed embodiment, although it should be understood that a greater or lesser number of absorbent elements may alternatively be used. Nevertheless, it is preferred that at least two such separate absorbent elements be utilized, aligned in tandem within the housing 11 as disclosed herein. Each such absorbent element 26*a*–26*c* is made of a knitted mesh of ferrous or nonferrous material, preferably metallic wire having relatively good heat-transfer characteristics for effective dissipation of heat and consequent temperature reduction of the propellant gases entering the suppressor. In a specific embodiment of suppressor according to the present invention, the absorbent elements comprise knitted mesh made of copper wire for good thermal conductivity and resistance to corrosion. The knitted mesh of the absorbent elements 26*a*–26*c* is closely wound, defining a multitude of tortuous paths for the flow of gases through the absorbent elements.

Each of the absorbent elements 26*a*–26*c* takes the shape of an annular cylinder having an axial passage allowing bullets to travel through the suppressor. The axial passages 27*b* and 27*c* of the corresponding absorbent elements 26*b* and 26*c* are of relatively small diameter, just sufficient for unimpeded passage of the bullet therethrough. The axial passage 27*a* through the absorbent element 26*a* is of somewhat larger diameter to accommodate the neck 17 of the connector sleeve 14, as best shown in FIG. 3. The absorbent element 26*a* thus is a sliding fit on the neck of the connector sleeve 14. The outer diameter of each absorbent element 26*a*–26*c* preferably permits a close sliding fit within the housing 11, so that the internal diameter of the housing is substantially filled by the absorbent elements.

Interposed between adjacent absorbent elements are the triangular-shaped baffles 30*a* and 30*b*. These baffles preferably are made of a flexible elastomeric material, and each baffle has a central opening 31 (FIG. 4) through which bullets pass. However, the baffles 30*a* and 30*b* may be manufactured in the form of blank pieces as depicted in FIG. 2, lacking any central opening; the first round fired through the suppressor will form its own boresight central openings through the baffles. This arrangement not only reduces to some extent the cost of fabricating the baffles, but also assures that the openings 31 formed in the baffles are properly aligned.

Figure 4:
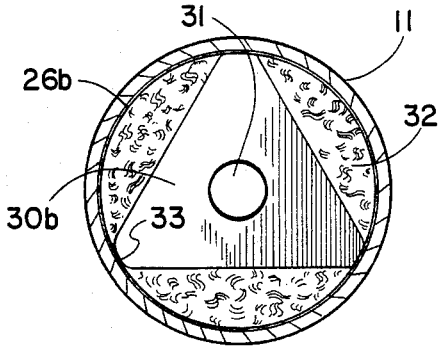
FIG. 4 is a transverse section view taken along line 4—4 of FIG. 3.

Referring now to FIG. 4, it is seen that the triangular shape of the baffle 30*b* covers substantially less than the entire end surface area 32 of the absorbent element 26*b*. The triangular shape of the baffle 30*b* exposes three such end surface areas 32 on the end of the absorbent element 26*b*; the corners 33 of the baffle may be truncated to conform to the inner circumference of the suppressor housing 11, thereby keeping the baffle substantially centered within the housing. The baffle 30*a* between the adjacent absorbent elements 26*a* and 26*b* likewise is triangular, leaving the confronting end surfaces of those two absorbent elements partially exposed. Each baffle 30*a* and 30*b* is sufficiently thick to maintain a space 35 between the confronting end surface areas of adjacent absorbent elements.

A circular bullet wiping seal 36 is disposed between the back of the encapsulator 21 and the forward end of the front absorbent element 26*c*. The seal 26, which may be of an elastomeric material the same as the baffles 30*a* and 30*b*, seals the forward end of the suppressor housing 11 and provides a close compression fit of all suppressor elements within the housing as the encapsulator 21 is threaded into the front end 12 of the housing. As seen in FIG. 2, the seal 36 may be formed without a central opening, the first round fired through the suppressor forming the necessary opening as with the baffles 30*a* and 30*b*.

When a firearm fitted with the suppressor 10 is fired, the bullet serially passes through the several suppressor sections defined by the separate absorbent elements 26*a*–26*c* and the baffles 30*a*, 30*b* interposed between adjacent absorbent elements. The expanding propellant gases immediately behind the bullet disperse into the absorbent elements, radiating outwardly into these elements from the axial passages 27 through the elements. These propellant gases enter and disperse through the aforementioned tortuous passages defined by the knitted wire material of the absorbent elements, lowering the temperature of the propellant gases by heat transfer to the wire mesh. The energy of the propellant gases within the suppressor thus is reduced as the gas temperature falls, so that the noise or report of firing is muffled or significantly suppressed as the bullet exits the axial passage 23 through the encapsulator 21 at the front end of the suppressor.

The use of separate absorbent elements 26*a*–26*c*, set off by the baffles 30*a* and 30*b*, improves the energy-absorbing capability of the suppressor by providing separate energy-absorbing sections for receiving the expanding propellant gases following the bullet through the suppressor. The exposed end surface areas 32 of confronting adjacent baffles, aided by the space 35 between adjacent absorbing elements, increases the exposed surface area of the absorbent elements available for gas dispersion within the suppressor, and thus further enhances the noise-suppressing effectiveness of the suppressor without need for increasing the size of the absorbent elements.

It should be understood that the foregoing pertains only to a disclosed embodiment of the present invention, and that numerous changes and modifications therein may be made without departing from the spirit or scope of the invention as set forth in the following claims.

I claim:

1. Sound suppressor apparatus for use with firearms, comprising:

a tubular housing attachable to the muzzle end of a firearm and defining a hollow interior surrounding a path along which bullets can travel;

plural elements of absorbent material disposed along the hollow interior of said housing, in surrounding relation with said bullet path, said absorbent material operative to receive propellant gases in the bullet path;

a fluid-impervious baffle between at least two adjacent elements of absorbent material and covering substantially less than the entire end area of said adjacent elements, leaving the uncovered end area portions exposed to permit passage of gas therethrough, thereby increasing the absorption of propellant bases and attendant reduction in energy of the gases;

each said fluid-impervious baffle having substantially a triangular shape and having a plurality of discrete radial extremities which contact the inside of said tubular housing and maintain said baffle centrally located across the hollow interior of the housing; and each baffle having noncircular outer edges extending between said radial extremities and spaced radially inwardly from said extremities, so that the regions between said noncircular outer edges and the inside of the tubular housing are unoccupied by the baffle and thereby leave uncovered the adjacent end portions of said absorbent elements, allowing the gases to flow through the uncovered end portions and thereby increasing the reduction in the energy in the gases.

2. Suppressor apparatus as in claim 1, wherein:

said baffle maintains a space between said uncovered end area portions, so as to facilitate gas flow through the uncovered end area portions.

3. Suppressor apparatus as in claim 1, wherein said baffle is an elastomer, and said elements of absorbent material are nonelastomers.

4. Suppressor apparatus as in claim 1, wherein:

each said element comprises a knitted wire mesh.

5. Suppressor apparatus as in claim 4, wherein each said element comprises an annulus having a hollow interior to provide a longitudinal passage aligned with the bullet path, and surrounding said path with a labyrinth of interstitial spaces defined by said knitted wire mesh, so that propellant gases from the firearm enter the interstitial spaces and a portion of the energy in the gases thus is absorbed.

6. Suppressor apparatus as in claim 5, wherein said wire mesh is a relatively good thermal conductor so as to absorb heat in the propellant gases, thereby reducing the energy of the propellant gases.

7. Suppressor apparatus as in claim 1, wherein:

said baffles have sufficient thickness to maintain a gas-receiving space between the uncovered portions of the confronting end surfaces of adjacent absorbing elements.

* * * * *